US006367120B2

(12) United States Patent
Beauchamp

(10) Patent No.: US 6,367,120 B2
(45) Date of Patent: Apr. 9, 2002

(54) CARPET CLEANING APPARATUS WITH LOOP AGITATOR

(76) Inventor: David A. Beauchamp, 762 Raab Ct., Gardnerville, NV (US) 89410

( * ) Notice: Subject to any disclaimer, the term of this patent is extended or adjusted under 35 U.S.C. 154(b) by 0 days.

(21) Appl. No.: 09/036,590

(22) Filed: Mar. 6, 1998

Related U.S. Application Data

(60) Provisional application No. 60/070,773, filed on Jan. 8, 1998, and provisional application No. 60/040,484, filed on Mar. 7, 1997.

(51) Int. Cl.[7] ..... A47L 11/19

(52) U.S. Cl. ..... 15/363; 15/320; 15/366; 15/383; 15/41.1; 15/52.1; 15/5

(58) Field of Search ..... 15/386, 383, 141.2, 15/179, 5, 320, 364, 365, 366, 374, 401, 398, 41.1, 42, 52.1, 50.3, 88.4, 182

(56) References Cited

U.S. PATENT DOCUMENTS

| | | | | |
|---|---|---|---|---|
| 1,894,361 | A | * | 1/1933 | Shank |
| 2,064,857 | A | * | 12/1936 | Riebel |
| 2,476,537 | A | * | 7/1949 | Erickson |
| 2,512,544 | A | * | 6/1950 | Hammell |
| 3,840,935 | A | | 10/1974 | Fitzgerald, Jr. et al. |
| 4,573,235 | A | * | 3/1986 | Baird, Sr. |
| 5,020,186 | A | * | 6/1991 | Lessig et al. |
| 5,185,898 | A | * | 2/1993 | Johnson |
| 5,640,738 | A | * | 6/1997 | Williams et al. |

* cited by examiner

*Primary Examiner*—Deborah Jones
*Assistant Examiner*—Jennifer McNeil

(57) ABSTRACT

A carpet cleaning apparatus is disclosed with a loop agitator. The loop agitator comprises a spindle with a plurality of flexible loops attached to the spindle. A blade is provided in close relative proximity to the agitator for severing hair and other fibers that become entangled on the agitator.

20 Claims, 3 Drawing Sheets

CARPET CLEANING APPARATUS WITH LOOP AGITATOR

CROSS REFERENCES TO RELATED APPLICATIONS

This application claims priority of U.S. provisional patent application serial numbers 60/040,484 and 60/070,773, filed on Mar. 7, 1997 and Jan. 8, 1998, respectively.

BACKGROUND OF THE INVENTION

1. Field of Invention

The present invention relates to a device for cleaning carpets, rugs, floor coverings, upholstery, and other material.

2. Description of Related Art

Carpet cleaning machines are well known in the art. Numerous machines and devices related to these machines have been developed for domestic and commercial use. Most carpet cleaning devices operate by applying a solution of water and cleaning chemicals to a carpet, agitating the carpet, and vacuuming the solution, dissolved soil, and loose debris into a tank. However, most of these devices have undesirable characteristics or fail to achieve a desired level of performance. For example, most carpet cleaning devices have at least one of the following failings:

They are heavy requiring a great deal of effort to transport and maneuver;

They use a large amount of water and leave a large amount of water and cleaning solution in a carpet during a cleaning process;

Some styles of devices reuse dirty water during cleaning thereby decreasing cleaning efficiency.

They do not remove objects from wastewater that could damage wastewater removal pumps;

They do not efficiently eliminate suds in their vacuum ducts;

The agitators are inefficient and destructive to carpets;

The agitators become clogged with hair and other objects; and

They have poor overall cleaning efficiency.

Although these problems and failings have long been recognized, little has been done to improve existing carpet cleaning devices. Manufacturers and users have come to accept these problems as part and parcel of carpet cleaning devices. What has long been needed is a means for improving carpet cleaning devices to reduce or eliminate these failings.

SUMMARY OF INVENTION

1. Objects of the Invention

It is an object of the present invention to provide an improved apparatus for cleaning carpets, rugs, floor coverings, upholstery, and other materials and objects.

It is a further object of the present invention to provide a cleaning apparatus that utilizes a rotating agitator with loops or fins of flexible material.

It is another object of the present invention to provide the rotating agitator described above wherein the loops or fins are mounted at an angle to the direction of rotation.

It is another object of the present invention to provide a blade in close proximity to a rotating agitator for cutting hair before they wind around the agitator.

It is a further object of the present invention to provide a carpet cleaning apparatus with rigid skid rails for structurally supporting the cleaning apparatus.

These and other objects of the present invention may be realized by reference to the remaining portions of the specification, claims, and abstract.

2. Brief Description of the Invention

The carpet cleaning apparatus of the present invention comprises an agitator with a substantially cylindrical spindle and a plurality of loops attached to the spindle. The loops are adapted to agitate and massage fibers on a carpet or material. A blade is located in close relative proximity to the agitator for cutting hair that become entangled on the agitator.

A vacuum duct is provided for vacuuming wastewater and debris into the apparatus.

REFERENCE NUMERALS

Figure 1:
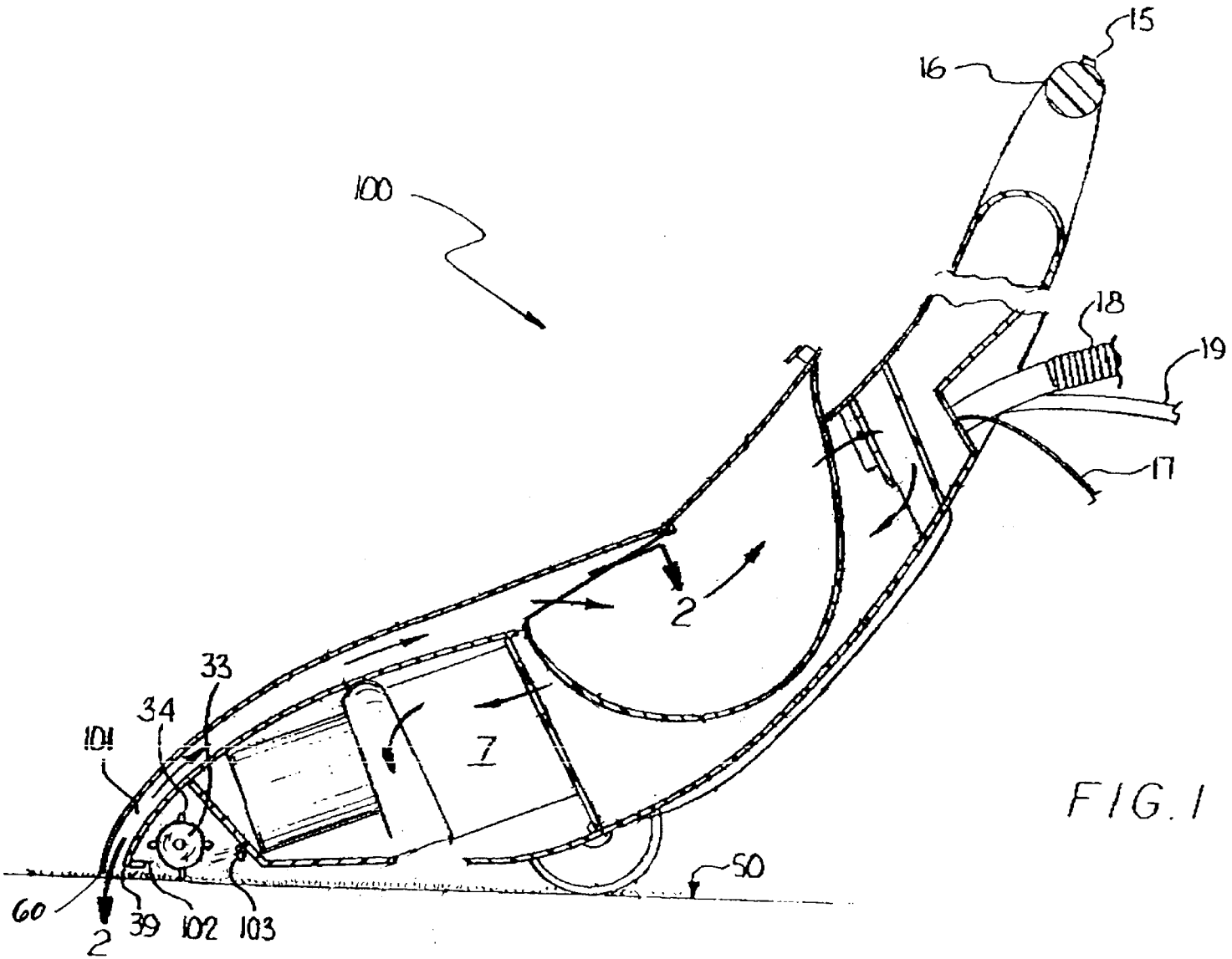
FIG. 1 is a cross sectional side view of the cleaning device of the present invention taken along line 1—1 in FIG. 2.

7 vacuum motor
9 electrode
10 electrode
11 basket
15 switch
16 handle
17 cord
18 hose
19 wastewater line
20 pump
21 valve
22 chemical tank
23 bag
25 switch
26 switch
31 valve
33 agitator
34 loops or fins
35 spindle
37 squeegee elements
39 rear lip
50 carpet or material
52 direction of rotation
54 first row of loops
56 second row of loops
60 front lip
62 screen
67 vacuum
68 wire and hose
69 air duct
100 device
101 inlet duct
102 blade
103 spray jets
104 holes
106 holes
108 side rails
112 skids
114 hinge
116 solid center portion

120 nozzle
121 tube
135 drive motor

DESCRIPTION OF THE PREFERRED EMBODIMENT

Figure 2:
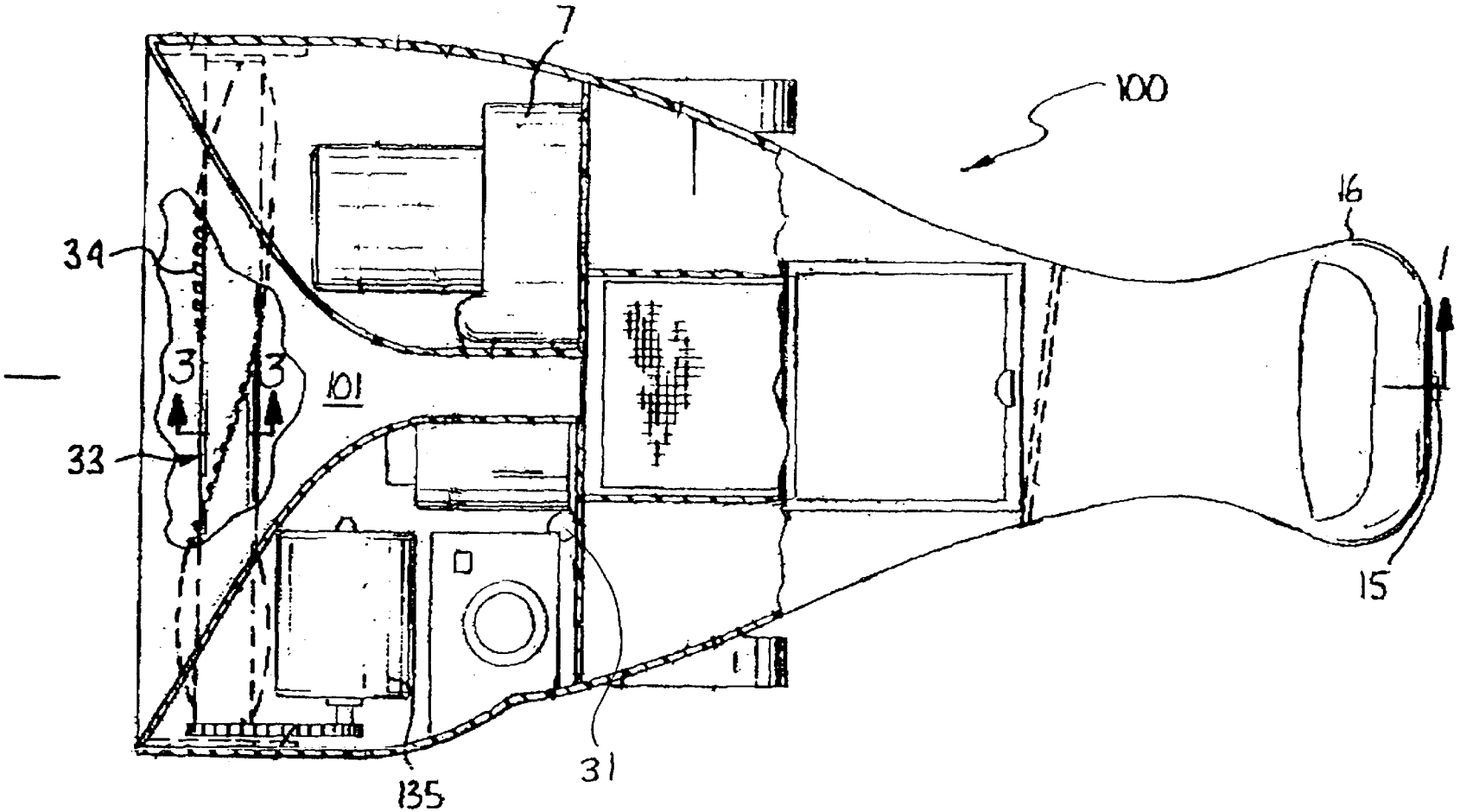
FIG. 2 is a partial cross sectional plan view of the cleaning device of the present invention taken along line 2—2 of FIG. 1.

As seen in FIGS. 1 and 2, the present invention comprises a cleaning device generally indicated by reference number 100. Device 100 is adapted to utilize external supplies of electricity and water. A cord 17 is attached to an electrical outlet (not shown) and hose 18 is attached to a faucet or other water source (not shown) with a standard faucet adapter that is well known in the art. Cleaning chemicals are preferably added to water in hose 18 by a chemical injector at the point where the cleaning hose connects to the faucet. Injectors and other similar devices are well known in the art and they are commonly used to add cleaning chemicals to water in a predetermined proportion. The water and cleaning chemicals are mixed as they travel through hose 18 and device 100 to form a cleaning solution that is used to clean a carpet or material 50. A wastewater line 19 is also provided for removing wastewater. Preferably cord 17, hose 18, and wastewater line 19 are 50 to 80 feet long.

A switch 15 is provided on a handle 16 to activate a 24 volt solenoid valve 31 that allows the solution to spray out of spray jets 103. No pump is needed to spray the solution as the invention utilizes water pressure provided at the faucet. This feature helps reduce the weight, cost, and complexity of device 100.

Device 100 includes a number of innovations that allow it to use less water and cleaning chemicals during cleaning operations. The streams of solution also are directed towards agitator 33. As the solution strikes agitator 33, which is normally rotating, the solution is further dispersed.

The dispersed solution allows the solution to soak into the fibers of material 50 faster than would otherwise be possible. This results in a number of advantages including the following:

- Less water and cleaning chemicals are needed to clean the material;
- Device 100 does not need to remove as much solution from the material, which allows the device to be smaller, lighter, and less expensive; and
- The backing of the material does not become saturated with water, which allows the material to dry faster, prevents mildew, and prolongs the life of the material.

Agitator 33 is adapted to rotate on the bottom of device 100 where the agitator is in contact with material 50. In the preferred embodiment, a drive motor 135 is provided for driving agitator 33 so that the lower portion of the agitator moves from back to front relative to device 100.

Figure 3:
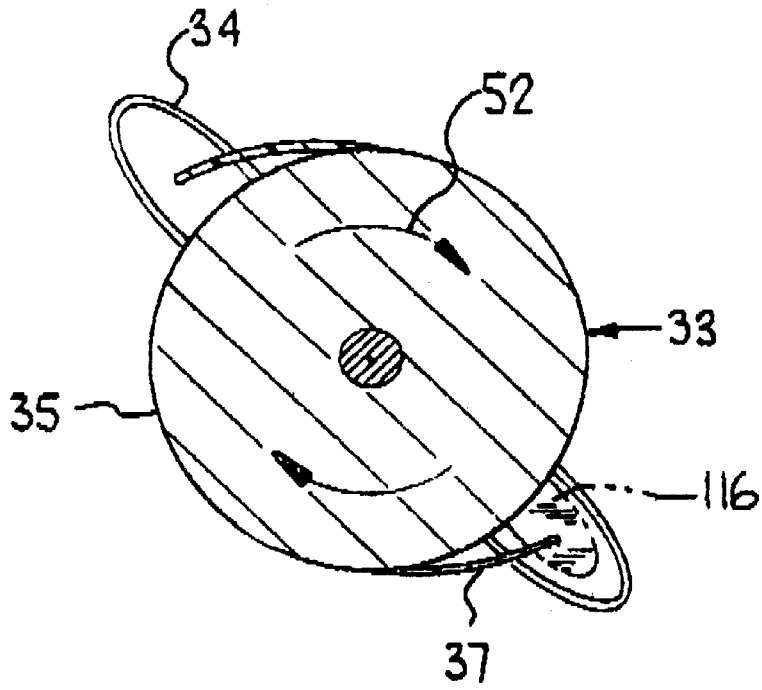
FIG. 3 is a cross sectional view of the agitator of the present invention taken along line 3—3 of FIG. 2.

As seen in FIG. 3, agitator 33 comprises a substantially cylindrical spindle 35 and a plurality of flexible loops or fins 34. Spindle 35 is adapted to rotate around a central axis. Loops 34 are preferably made of a flexible material, such as nylon or other synthetic materials that allow the loops to absorb impacts with hard objects. Loops may be a continuous fiber that are attached to spindle 35. In the preferred embodiment, two helical rows of loops 34 are attached to spindle 35. However, a greater or lesser number of rows may be used and the rows may be straight. Alternatively, loops 34 may have a solid center portion 116. Thus, loops 34 may be substantially planar fins. Loops 34 with solid center portion 116 may have the advantage that they are less expensive to manufacture and are more wear resistant.

Flexible loops 34 are a significant improvement over prior art agitating brushes because the loops will not tear or damage the fibers in carpets as brushes tend to do. Carpets are made up of tufts of fibers that are bond to a carpet backing. As the bristles of brushes move over a carpet, they are inserted into and pass through the tufts of fibers in a rake-like action. This action tends to tear and separate the fibers in the tufts. Brushes also force the fibers flat against the carpet backing. This applies stress to the fiber ends that may cause fibers to separate from the backing.

Loops 34 do not suffer from these problems because the loops move past the tufts and do not penetrate the tufts. Loops 34 comprise a leading edge that is wider than the leading edge of rush bristles. Loops 34 also have a rounded profile that does not catch on carpet fiber loops. These characteristics allow loops 34 to massage tufts rather than rake the tufts.

Loops 34 are also self-cleaning. Brushes tend to get clogged with hair, carpet fibers, and other debris, especially when the carpet is wet. Flexible loops 34, on the other hand, have less surface area upon which debris may rest. Consequently, loops 34 seldom become clogged or bound by debris.

The present invention does not require a height adjustment mechanism to adjust the height of the agitator as is required with brush agitators. The height of brush agitators must be adjusted to prevent deep penetration of carpet tufts. If the height is not properly adjusted, a brush agitator will quickly destroy a carpet by ripping fibers out of the backing. Loops 34 of agitator 33 go through carpets without penetrating the tufts of the carpet fibers. Therefore, agitator 33 will not destroy the carpet if it is not adjusted to a proper height.

The agitator of the present invention is also very effective at cleaning chemical laden carpets. Many carpet cleaning devices use excessive amounts of cleaning chemicals or they use chemicals that leave a heavy residue. After several cleanings with these chemicals, a crusty layer of hardened chemicals tends to accumulate in the backing and fibers of the carpet. Unlike brush agitators, agitator 33 of the present invention provides enough rigidity to break up and loosen the hardened chemicals without damaging the carpet.

Another advantage of agitator 33 is that it is not required to rotate at high speeds. In the preferred embodiment, agitator 33 rotates at 850 revolutions per minute. This is substantially slower than many prior art brush agitators. The slower speed helps prevent damage to materials and does not require a large drive mechanism. A smaller drive mechanism allows device 100 to be smaller, lighter, and less expensive than prior art devices.

Figure 4A:
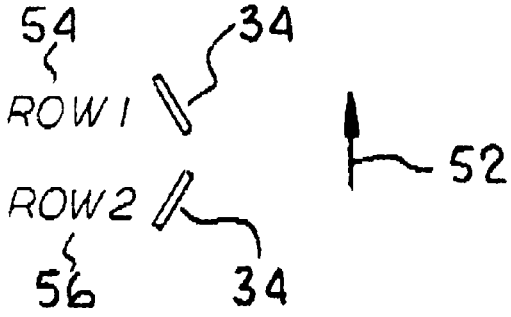
FIGS. 4*a* and 4*b* are schematic representations of the relative orientation of loops or fins of the present invention.
Figure 4B:
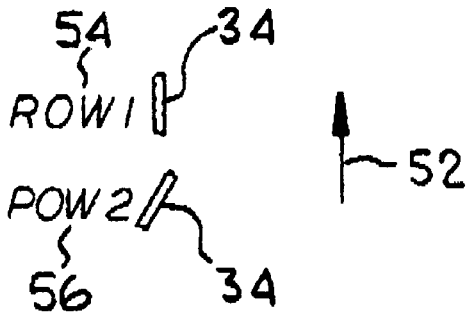

As seen in FIG. 4A, flexible loops 34 may be attached to spindle 35 at an angle to the direction of rotation 52. In other words, the mounting angle or angular orientation of each loop 34 may not be in line with the direction of rotation. This angular orientation produces a greater agitating action in fibers of carpet 50 as the tufts of fibers are forced to move along the side of each loop 34. In addition, each row of loops may have a different angular orientation. For example, a first row of loops 54 may be angled to the left of direction of rotation 52 and a second row of loops 56 may be angled to the right of direction of rotation 52. This alternating angular orientation further enhances the agitating action of agitator 33 as the fibers in the carpet are vibrated in two directions. Alternatively, as seen in FIG. 4B, first row of loops 54 may be aligned with the direction of rotation 52 with no angular orientation and second row of loops 56 may have an angular orientation.

Returning to FIG. 3, a plurality of squeegee elements 37 may also be provided on spindle 35 for squeezing water and soil out of material 50 as agitator 33 rotates. This allows device 100 to remove more wastewater more quickly than prior art agitating devices. Having less liquid in material 50 allows the material to dry more quickly.

Agitator 33 may also be used on a variety of cleaning equipment. Carpet cleaning devices, vacuums, and other devices utilize agitators. These devices may be easily adapted to utilize agitator 33 of the present invention to benefit from its many advantages.

It has been found that prior art agitators have a tendency to become wound or entangled with large amounts of hair, animal fur, and other fibers that decrease the efficiency of the agitators. Returning to FIGS. 1 and 2, the present invention reduces this problem by providing a blade 102 in close relative proximity to agitator 33. Blade 102 comprises a sharp edge that cuts long fibers as agitator 33 rotates. Preferably, blade 102 is substantially $1/8^{th}$ of an inch away from agitator loops 34 to prevent impacts between the loops and the blade. Blade 102 preferably has a serrated edge but a smooth edge may also be used.

An inlet duct 101 is provided for removing wastewater, soil, and debris. A rear lip 39 of the opening of duct 101 is preferably 20 thousandths of an inch above the floor and a front lip 60 of the opening of duct 101 is in contact with the floor. A negative pressure is created by vacuum motor 7 which draws water and debris out of carpet 50 upwards through duct 101.

SUMMARY

It may now be seen from the above description that the present invention provides a novel carpet cleaning device. The device comprises a number of components and features that provide a number of advantages and improvements over the prior art. For example, the present invention is smaller, lighter, and less expensive to manufacture than prior art carpet cleaning devices. The present invention is also less destructive to carpets and material, uses less water, and is able to remove more soil than prior art devices.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A cleaning apparatus comprising an agitator for agitating a material and disturbing debris in the material, means for rotating said agitator, means for supplying and directing a solution toward the agitator and further disperse the solution onto said material, means for supplying suction to remove said solution and debris from the material, wherein the agitator comprises a spindle adapted to rotate around a central axis and further comprising at least one helical row of a plurality of flexible loops attached thereto, wherein the loops of the at least one helical row are mounted at an angle to the direction of rotation of the spindle.

2. The cleaning apparatus of claim 1 wherein the spindle has at least two helical rows of a plurality of flexible loops attached thereto, a first row of loops is angled to the left of the direction of rotation and a second row of loops is angled to the right of the direction of rotation.

3. The cleaning apparatus of claim 1 wherein said loops comprise a synthetic fiber.

4. The cleaning apparatus of claim 1 wherein said loops are substantially elastic.

5. The cleaning apparatus of claim 1 wherein said loops are nylon.

6. The cleaning apparatus of claim 1 wherein said loops comprise a substantially solid inner portion.

7. The cleaning apparatus of claim 1 wherein the spindle has at least two helical rows of a plurality of flexible loops attached thereto, and the loops of the at least two helical rows are mounted at an angle to the direction of rotation.

8. The cleaning apparatus of claim 1 wherein the agitator has at least one squeegee element attached thereto.

9. The cleaning apparatus of claim 1 wherein the solution is water, or a mixture of water and cleaning chemicals.

10. The cleaning apparatus of claim 1 wherein a blade is mounted on the cleaning apparatus in relatively close proximity to the agitator, said blade being adapted to sever objects wound on the agitator.

11. The cleaning apparatus of claim 10 wherein the blade is 1/8 of an inch away from the loops on the agitator.

12. The cleaning apparatus of claim 10 wherein the blade comprises an edge, the edge being substantially parallel to the central axis of the spindle.

13. The cleaning apparatus of claim 10 wherein the blade has a serrated edge.

14. A cleaning apparatus comprising an agitator for agitating a material and disturbing debris in the material, means for rotating said agitator, means for supplying and directing a solution toward the agitator and further disperse the solution onto said material, means for supplying suction to remove said solution and debris from the material, wherein the agitator comprises a spindle adapted to rotate around a central axis and further comprising at least one straight row of a plurality of flexible loops attached thereto, wherein the loops of the at least one straight row are mounted at an angle to the direction of rotation of the spindle.

15. The cleaning apparatus of claim 14 wherein said loops comprise a substantially solid inner portion.

16. The cleaning apparatus of claim 14 wherein the spindle has at least two straight rows of a plurality of flexible loops attached thereto, and the loops of the straight rows are mounted at an angle to the direction of rotation.

17. The cleaning apparatus of claim 14 wherein the agitator has at least one squeegee element attached thereto.

18. The cleaning apparatus of claim 14 wherein the spindle has at least two straight rows of a plurality of flexible loops attached thereto, a first row comprises loops angled to the left of the direction of rotation and a second row comprises loops angled to the right of the direction of rotation.

19. The cleaning apparatus of claim 14 wherein a blade is mounted on the cleaning apparatus in relatively close proximity to the agitator, said blade being adapted to sever objects wound on the agitator.

20. The cleaning apparatus of claim 14 wherein the blade comprises an edge, the edge being substantially parallel to the central axis of the spindle.

* * * * *